US007729504B2

(12) United States Patent
Tsuda et al.

(10) Patent No.: US 7,729,504 B2
(45) Date of Patent: Jun. 1, 2010

(54) FERROFLUID CENTERED VOICE COIL SPEAKER

(75) Inventors: Shiro Tsuda, Asahi (JP); Ronald E. Rosensweig, Summit, NJ (US)

(73) Assignee: Ferrotec Corporation, Youkaichiba (JP)

( * ) Notice: Subject to any disclaimer, the term of this patent is extended or adjusted under 35 U.S.C. 154(b) by 295 days.

(21) Appl. No.: 11/668,736

(22) Filed: Jan. 30, 2007

(65) Prior Publication Data

US 2007/0189577 A1 Aug. 16, 2007

Related U.S. Application Data

(60) Provisional application No. 60/766,831, filed on Feb. 14, 2006.

(51) Int. Cl.
*H04R 25/00* (2006.01)

(52) U.S. Cl. ..... 381/415; 381/396; 381/414

(58) Field of Classification Search ..... 381/396–397, 381/400, 407, 410–412, 414–415
See application file for complete search history.

(56) References Cited

U.S. PATENT DOCUMENTS 4,017,694 A 4/1977 King
4,320,263 A 3/1982 Thiele
4,414,437 A 11/1983 Trauernicht et al.
5,335,287 A 8/1994 Athanas
5,461,677 A 10/1995 Raj et al.
6,208,743 B1 * 3/2001 Marten et al. ..... 381/415

OTHER PUBLICATIONS

Bottenberg, W. et al., "The Dependence of Loudspeaker Design Parameters on the Properties of Magnetic Fluids," Presented at the 61st Convention of the Audio Engineering Society, Nov. 3-6, 1978, pp. 1-25.

* cited by examiner

*Primary Examiner*—Suhan Ni
(74) *Attorney, Agent, or Firm*—Robert R Deleault, Esq.; Mesmer & Deleault, PLLC

(57) ABSTRACT

An audio speaker has a driver unit having a support frame with a central portion forming a magnetic structure defining an annular gap around a central magnetic post, a vibration system having a diaphragm and a voice coil, the voice coil is attached to one side of the diaphragm where the vibration system is fixed to the support frame and where the voice coil is movably mounted in the annular gap, and a magnetic fluid disposed in the annular gap only in a space between one side of the voice coil and a surface of the annular gap having a higher magnetic flux density.

10 Claims, 2 Drawing Sheets

FERROFLUID CENTERED VOICE COIL SPEAKER

This application claims the benefit of U.S. Provisional Patent Application No. 60/766,831, filed Feb. 14, 2006.

BACKGROUND OF THE INVENTION

1. Field of the Invention

The present invention relates to audio speakers. Particularly, the present invention relates to audio speakers that utilize liquid suspension mechanisms for the voice coils incorporated into audio speakers.

2. Description of the Prior Art

Audio speakers produce audible sounds by displacing air by way of the movement of a diaphragm. The diaphragm is attached to and moves under the control of a voice coil, through which electric currents associated with the sounds to be reproduced are driven. The voice coil is disposed in an annular air gap of a magnetic structure. The magnetic structure includes a permanent magnet that provides radial flux in the air gap. Current through the coil interacts with this radial flux to provide axial forces on the coil and causes displacement of the coil and the attached diaphragm.

The alignment of the voice coil in the air gap is crucial to the performance of an audio speaker. Any scraping of the voice coil against the sides of the air gap causes humming and distortion, which affects sound quality. Additionally, scraping creates undesirable stresses on the suspension system as well as removal of the insulation from the coil windings. This leads to early speaker failure. Speaker manufacturers commonly employ a flexible, fibrous element called a spider to align the voice coil in the air gap. The inclusion of a spider requires additional space in the speaker, which is not available in audio speakers such as tweeters and very small full range speakers.

For over 25 years, air gaps in some audio speakers have been filled with magnetic fluids (also called ferrofluids). These ferrofluids offer significant performance advantages in tweeters, midrangers, woofers, compression drivers, and automotive speakers. Ferrofluids are used for a wide variety of reasons such as damping of the voice coil, heat transfer, reduction in harmonic distortion, lubrication, and centering of the voice coil in the air gap.

A unique aspect of ferrofluid is its ability to exert a radial force on the voice coil, which has come to be known as the centering force. The magnitude of this force depends on the magnetization of the ferrofluid and the magnetic flux density in the air gap of the speaker. The higher the magnetization and flux density, the greater the radial force. The radial force keeps the voice coil properly aligned as it vibrates in the gap in response to an audio signal without scraping against the metal pieces, e.g. pole piece and front plate, forming the gap.

In a 1980 AES publication by Bottenberg et al., titled "The Dependence of Loudspeaker Design Parameters on the Properties of Magnetic Fluids," which was presented at the 61$^{st}$ Convention of the Audio Engineering Society, Nov. 3-6, 1978, the authors derived a mathematical expression for the ferrofluid radial force for a 1 inch dome tweeter having the gap on both sides of the coil filled with a ferrofluid. Many tweeter manufacturers now take advantage of the centering force of ferrofluid by filling the gap on both sides of the coil and thus requiring no mechanical centering device, i.e. a spider.

Unfortunately, the use of ferrofluid in the air gap causes other problems. The air gap is connected to a cavity between the speaker magnet and various components of the magnetic structure. Ferrofluid in the air gap acts like an O-ring seal between the voice coil and the magnetic structure. The cavity is essentially sealed off from the air space in front of the front plate. As the voice coil moves or as the temperature rises, it tends to elevate the air pressure within this cavity. If the pressure builds up to a point where it exceeds the pressure capacity of the ferrofluid O-ring seal, the air bursts through the seal and relatively large amounts of the ferrofluid may then be blown or flow out of the gap. One solution to this problem was addressed by U.S. Pat. No. 5,335,287.

U.S. Pat. No. 5,335,287 (1994, Athanas) discloses a loudspeaker with a viscous magnetic fluid suspension for the voice coil rather than the corrugated disk suspension that is conventionally used. Specially designed vent passages are formed in the magnet assembly in order to prevent internal pressure from either building up or creating sub-atmospheric conditions that could cause the magnetic fluid to be blown out of the magnetic gap. The patent also discloses that the mechanical centering device can be eliminated even in more demanding high excursion woofers by utilizing ferrofluids of high magnetization values such as 600-800 Gauss filling the gap on both sides of the voice coil.

Other problems that arise when using ferrofluid in the air gap around the voice coil involve equalization of the amount of ferrofluid on both sides of the voice coil (because filing the entire gap can be problematic) and equalization of the air pressure under the dust cap of the voice coil. To address these problems, a plurality of vent openings were incorporated in the voice coil adjacent the dome end of the voice coil such as is disclosed in U.S. Pat. No. 4,414,437.

U.S. Pat. No. 4,414,437 (1983, Trauernicht et al.) discloses a moving coil dynamic transducer. The electromagnetic transducer (voice coil) includes a member producing a magnetic field and presenting an air gap traversed by the magnetic field, a mass of magnetic fluid extending across the air gap, and a moving coil mounted on a moving coil carrier supported for movement through the air gap. The moving coil carrier is provided with at least one passage located to communicate with the magnetic liquid during at least part of the movement of the coil carrier through the air gap. The passage permits flow of magnetic liquid from one side to the other of the carrier in the direction of the air gap. This provides an equalization of the magnetic liquid on each side of the voice coil.

Therefore, what is needed is an audio speaker that uses ferrofluid for centering a voice coil without the need for ferrofluid equalizing vent openings. What is also needed is an audio speaker that uses ferrofluid for centering a voice coil without the need for ferrofluid equalizing vent openings or the use of a spider.

SUMMARY OF THE INVENTION

It is an object of the present invention to provide an audio speaker that uses ferrofluid for centering a voice coil without the need for ferrofluid equalizing vent openings. It is another object of the present invention to provide an audio speaker that uses ferrofluid for centering a voice coil without the need for ferrofluid equalizing vent openings or the use of a mechanical centering device such as a spider. It is a further object of the present invention to provide an audio speaker that uses a ferrofluid for centering a voice coil having low volatility and lower magnetization than previously required for high excursion woofers.

The present invention achieves these and other objectives by providing an audio speaker with a driver unit, a vibration system and magnetic fluid disposed in an annular gap only between one side of a voice coil and a surface of the annular gap. The driver unit includes a support frame with a central portion forming a magnetic structure with an annular gap around a central magnetic post. The vibration system has a diaphragm and a voice coil. The voice coil is attached to one side of the diaphragm and movably mounted within the annular gap. The diaphragm is flexibly connected on its periphery to the support frame. The voice coil includes a tubular form with an electrical winding on the outer surface of the tubular form. The electrical winding is preferably axially centered in the annular gap.

The major features of the present invention are the placement of magnetic fluid on only one side of the voice coil to create a centering force to keep the voice coil centered in the annular gap and the lack of the requirement for a mechanical centering device such as a spider. The magnetic fluid is positioned in the space on the side of the voice coil having the higher magnetic flux density. Another important aspect of the present invention is the requirement to prevent the migration of the magnetic fluid from one side of the voice coil to the other.

It should be noted that the magnetic gap or air gap may be thought of as having a gap portion of higher magnetic field that diminishes in strength across the gap to a gap portion of lower magnetic field. Magnetic fluid will naturally reside in a gap portion of higher magnetic field. The magnetic fluid, however, will migrate to a gap portion of lower magnetic field located at the corners of the pole piece that is situated in the lower magnetic field unless the gap portions are separated. The tubular form of the voice coil of the present invention is structured to maintain gap portion separation and prevent magnetic fluid migration.

In one embodiment, the magnetic structure of the driver unit is an assembly that includes a base plate with a central magnetic post, an annular permanent magnet and an annular top plate. The annular permanent magnet is sandwiched between the base plate and the annular top plate. The base plate and the central magnetic post may be made from a single piece of magnetic material or may be two or more pieces integrally joined together to form an inverted, T-shaped pole piece. The annular permanent magnet is axially polarized where one face of the magnet has one polarity and the other face has the opposite polarity.

The central magnetic post extends from the base plate through the central space formed within the annular magnet and the annular top plate forming a centrally located pole piece. The base plate, annular top plate and the central magnetic post are formed of a magnetizable material and together with the annular permanent magnet define a magnetic circuit having an annular gap. With the voice coil placed in position within the annular gap, the space between the outer surface of the voice coil and the inner surface of the annular top plate has a higher magnetic flux density than the space between the inner surface of the voice coil and the outer surface of the central magnetic post.

In this embodiment of the present invention, the magnetic fluid is placed between the outer surface of the voice coil and the inner surface of the annular top plate. This position provides a larger centering force than the minimal centering force provided in audio speakers of the prior art where the magnetic fluid is placed on both sides of the voice coil.

In another embodiment of the present invention, the magnetic structure of the audio speaker includes a magnetic housing preferably with a cylindrical wall and a bottom. The central magnetic post extends from the bottom through the central space formed by the cylindrical wall of the magnetic housing forming a centrally-located pole piece that includes a permanent magnet and a top pole piece. Like the magnet in the previous embodiment, the permanent magnet in the central magnetic post is axially polarized where one face of the magnet has one polarity and the other face has the opposite polarity. The magnetic housing and the top pole piece are formed of a magnetizable material. The magnetic housing and central magnetic post define the magnetic circuit having an annular gap between the outer surface of the top pole piece and the inner surface of the cylindrical wall.

With the voice coil placed in position within the annular gap, the space between the inner surface of the voice coil and the outer surface of the top pole piece of the central magnetic post has a higher magnetic flux density than the space between the outer surface of the voice coil and the inner surface of the cylindrical wall of the magnetic structure. This is due to the permanent magnet being part of the central magnetic post. In this embodiment of the present invention, the magnetic fluid is placed between the inner surface of the voice coil and the outer surface of the central magnetic post.

The magnetic fluid used in the present invention has a magnetization preferably in the range of about 100 to about 600 Gauss. The choice of magnetization is dependent on the magnetic fluid that is most suited to achieve an adequate centering force. For instance, audio speakers with high excursion voice coils and low magnetic field require magnetic fluids with higher magnetization values. Audio speakers with low excursion voice coils and high magnetic field require magnetic fluids with lower magnetization values.

It is also important that the magnetic fluid, once positioned in the space on the side of the voice coil having the greater magnetic flux density, is prevented from migrating to the other side of the voice coil. One way to prevent magnetic fluid migration is to lengthen the tubular form that makes up the voice coil. The length of the tubular form should be sufficient so that the magnetic fluid cannot migrate around the end of the voice coil during the voice coil's greatest excursion as it oscillates. In addition, where vent openings are incorporated through the wall of the tubular form to equalize air pressure, the vent openings must be positioned so that the magnetic fluid does not contact the edge of the vent openings during the voice coil's greatest excursion as it oscillates. Allowing the magnetic fluid to migrate through the vent openings would also defeat the advantage of maximum centering force provided by the present invention.

It should be understood that the advantages of the present invention can be successfully incorporated in other speaker embodiments with magnetic air gaps. One example is an embodiment having a radially polarized magnet where an outer radial surface of the magnet has one polarity and the inner radial surface has the opposite polarity. The key aspect of the present invention is that, regardless of the speaker design, the magnetic fluid is always added to the portion of the magnetic gap on the side of the voice coil having the higher magnetic flux density.

DETAILED DESCRIPTION OF THE PREFERRED EMBODIMENT

Figure 1:
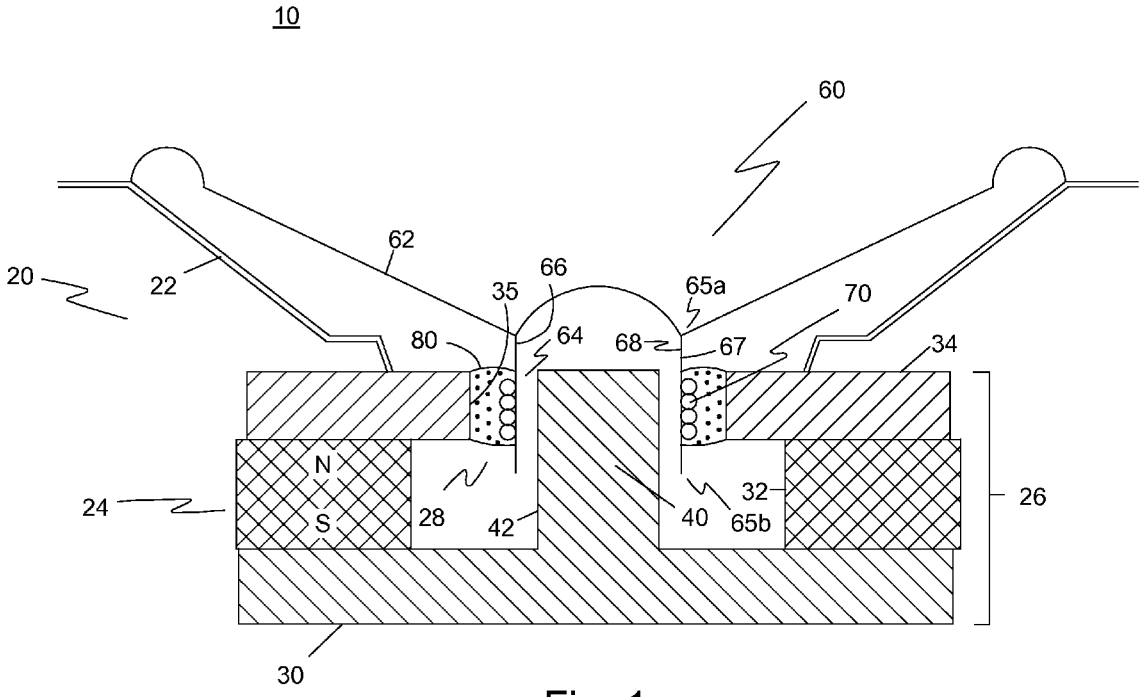
FIG. 1 is a simplified, cross-sectional view of one embodiment of the present invention showing an audio speaker with an annular magnet.
Figure 2:
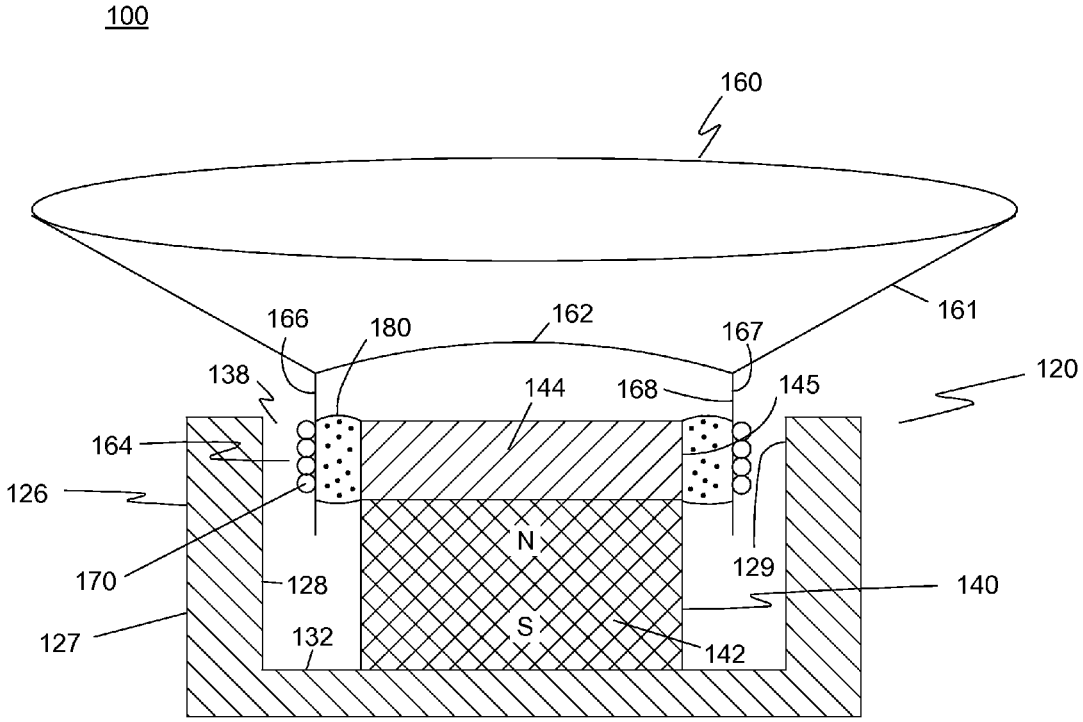
FIG. 2 is a simplified, cross-sectional view of another embodiment of the present invention showing an audio speaker with a magnet incorporated into the central post of the driver unit.

The preferred embodiment of the present invention is illustrated in FIGS. 1-2. FIG. 1 shows a simplified cross-section of one embodiment of an audio speaker 10. Audio speaker 10 includes a driver unit 20, a vibration system 60 and magnetic fluid 80. Driver unit 20 includes a support frame 22 and a central portion 24. Central portion 24 includes a magnetic structure 26 defining an annular gap 28 around a central magnetic post 40.

In this embodiment, magnetic structure 26 is an assembly having a base plate 30 with the central magnetic post 40, an annular permanent magnet 32 and an annular top plate 34. Base plate 30 and central magnetic post 40 may be made from a single piece of magnetic material or may be two or more pieces integrally joined. Annular permanent magnet 32 is axially polarized where one face of magnet 32 has one polarity and the other face of magnet 32 has the opposite polarity. Magnet 32 is sandwiched between base plate 30 and annular top plate 34.

Central magnetic post 40 extends from base plate 30 through the central space formed within annular magnet 32 and annular top plate 34 to form a centrally located pole piece. Base plate 30, annular top plate 34 and post 40 are formed of a magnetizable material and together with annular magnet 32 define a magnetic circuit having an annular gap 28 between a side surface 42 of post 40 and an inner edge 35 of annular top plate 34.

Vibration system 60 includes a diaphragm 62 and a voice coil 64. Voice coil 64 includes a tubular form 66 and an electrical winding 70 wound on an outer surface 67 of tubular form 66. Voice coil 64 is connected to diaphragm 62 at a proximal end 65*a* while a distal end 65*b* surrounds central magnetic post 40. Electrical winding 70 is preferably axially centered in annular gap 28. Winding 70 is shown in its de-energized state. When an A.C. signal is applied to electrical winding 70, the voice coil 64 will oscillate axially in both directions from the neutral position.

A major feature of the present invention is the disposition of viscous magnetic fluid 80 in the annular gap 28 on only one side of voice coil 64. Magnetic fluid 80 has a magnetization in the range of about 100 to about 600 Gauss, preferably, in the range of about 200 to about 500 Gauss, and, more preferably, in the range of about 300 to about 400 Gauss. In the embodiment shown in FIG. 1, magnetic fluid 80 is disposed between the outer surface 67 of voice coil 64 and the inner edge 35 of annular top plate 34. In the alternative, magnetic fluid 80 may be disposed between the inner surface 68 of voice coil 64 and the outer surface 42 of magnetic post 40. However, the space between outer surface 67 and inner edge 35 of annular top plate 34 in this embodiment has a higher magnetic flux density than the annular gap space between the inner surface 68 of tubular form 66 and side surface 42 of magnetic post 40.

The inventors' have discovered that placement of magnetic fluid 80 on only one side of voice coil 64 having the higher magnetic flux density provides a greater centering force on voice coil 64 than in audio speakers that use magnetic fluid on both sides of the voice coil for centering the voice coil. In fact in audio speakers that use magnetic fluid on both sides of the voice coil, the magnetic fluid provides minimal centering force. Further, placing the magnetic fluid on only the side of voice coil 64 having the lower magnetic flux density provides no apparent centering force.

Another feature of the present invention is that magnetic fluid 80 not be allowed to migrate from the higher magnetic flux density side of the voice coil 64 to the lower magnetic flux density side of voice coil 64. Thus, the tubular form 66 of voice coil 64 must be configured with a material and structure that prevents the magnetic fluid from getting to the lower magnetic flux density side.

Conventional tubular forms are made from a flat piece of material formed into a cylindrical shape having a longitudinal split between the opposing sides of the material. In addition, some conventional tubular forms include vent openings through the tubular form to allow equalization of air pressure and/or equalization of magnetic fluid located on both sides of the voice coil.

In the present invention, the tubular form 66 must be either a solid-walled tube or the longitudinal split must be covered with a material that will seal the split to effectively form a solid surface so as to prevent magnetic fluid 80 from migrating since it must be retained on only one side of voice coil 64. In addition, the tubular form 66 of the present invention must be long enough to prevent any accidental migration of magnetic fluid 80 from one side of voice coil 64 to the other during oscillation of voice coil 64. Vent openings may be used in the present invention, however, the vent openings must be positioned a sufficient distance from the magnetic fluid 80 so that magnetic fluid 80 will not reach the edge of the vent openings during the greatest oscillations of voice coil 64. Allowing magnetic fluid 80 to migrate through the vent openings will defeat the advantages of the present invention.

Turning now to FIG. 2, there is illustrated another embodiment of the present invention. In this embodiment, audio speaker 100 includes a driver unit 120, a vibration system 160 and magnetic fluid 180. Driver unit 120 includes a support frame portion (not shown) and a magnetic structure 126 defining an annular gap 138 around a central magnetic post 140.

In this embodiment, magnetic structure 126 is an assembly having a magnetic housing 127 preferably with a cylindrical wall 128 and a bottom 132. Central magnetic post 140 includes a permanent magnet 142 and a pole piece 144 on top of permanent magnet 142. Like its counterpart in FIG. 1, permanent magnet 142 is axially polarized where one face of magnet 142 has one polarity and the other face of magnet 142 has the opposite polarity. Central magnetic post 140 extends from bottom 132 through the central space formed by cylindrical wall 128 to form a centrally-located pole piece. Magnetic housing 127 and pole piece 144 are made of magnetizable material and, together with magnet 142, define a magnetic circuit having an annular gap 138 between outer surface 145 of pole piece 144 and an inner surface 129 of cylindrical wall 128.

Vibration system 160 includes a diaphragm 161, a dust cap 162 and a voice coil 164. Voice coil 164 includes a tubular form 166 and a coil winding 170 wound on the outer surface 167 of tubular form 166. In this embodiment, magnetic fluid 180 is disposed between the outer surface 145 of pole piece 144 and the inner surface 168 of voice coil 164. The space between the outer surface 145 of pole piece 144 and the inner surface 168 of voice coil 164 is the side of voice coil 164 with the higher magnetic flux density. This is so because the permanent magnet 142 forms a portion of central magnetic post 140. The annular gap space between the outer surface 167 of tubular form 166 and inner surface 129 of cylindrical wall 128 has lower magnetic flux density.

The present invention is applicable to all types of audio speakers such as tweeters, midranges, woofers, full ranges, etc. The magnetic field in the air gap as well as voice coil excursion (i.e. the total oscillation distance of the voice coil) differs from one speaker type to another. It was found that magnetic fluids having a magnetization in the range of about 100 to about 600 Gauss will be most suited to achieve an adequate centering force. As a general rule, audio speakers with high excursion voice coils and low magnetic field require magnetic fluids with higher magnetization values, i.e.

magnetization values in the upper portion of the indicated range. Audio speakers with low excursion and high magnetic field require magnetic fluids with lower magnetization values, i.e. magnetization values in the lower portion of the indicated range.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. An audio speaker comprising:

a driver unit having a support frame with a central portion forming a magnetic structure defining an annular gap around a central magnetic post;

a vibration system having a diaphragm and a voice coil, said voice coil attached to one side of said diaphragm wherein said vibration system is fixed to said support frame and wherein said voice coil is movably mounted in said annular gap; and a magnetic fluid disposed in said annular gap only in a space between one side of said voice coil and a surface of said annular gap having a higher magnetic flux density.

2. The audio speaker of claim 1 wherein said magnetic fluid has a magnetization in the range of about 100 to about 600 Gauss.

3. The audio speaker of claim 2 wherein said magnetic fluid has a magnetization in the range of about 200 to about 500 Gauss.

4. The audio speaker of claim 3 wherein said magnetic fluid has a magnetization in the range of about 300 to about 400 Gauss.

5. The audio speaker of claim 1 wherein said magnetic fluid has a higher magnetization when said audio speaker has a voice coil with higher excursion and lower magnetic field.

6. The audio speaker of claim 1 wherein said magnetic fluid has a lower magnetization when said audio speaker has a voice coil with lower excursion and higher magnetic field.

7. The audio speaker of claim 1 wherein said voice coil has a tubular form of sufficient length to prevent the migration of said magnetic fluid at a distal end of said voice coil from said one side of said voice coil to a second side of said voice coil.

8. The audio speaker of claim 7 wherein said tubular form of said voice coil has a solid surface.

9. The audio speaker of claim 1 wherein said one side of said voice coil is between an outside surface of said voice coil and a radial inside surface of said magnetic structure when an annular magnet defines a portion of a wall of said magnetic structure.

10. The audio speaker of claim 1 wherein said one side of said voice coil is between an inside surface of said voice coil and said central magnetic post when a permanent magnet defines a portion of said central magnetic post.

* * * * *